US010954714B2

(12) United States Patent
Jun et al.

(10) Patent No.: US 10,954,714 B2
(45) Date of Patent: Mar. 23, 2021

(54) FIREPROOF SHUTTER

(71) Applicant: SEMES CO., LTD., Cheonan-si (KR)

(72) Inventors: Seung Keun Jun, Jeju-si (KR); Young Woo Kim, Cheonan-si (KR); Tae Youl Youn, Cheonan-si (KR); Wang Hyeon Son, Cheonan-si (KR)

(73) Assignee: SEMES CO., LTD., Cheonan-si (KR)

( * ) Notice: Subject to any disclaimer, the term of this patent is extended or adjusted under 35 U.S.C. 154(b) by 124 days.

(21) Appl. No.: 16/106,509

(22) Filed: Aug. 21, 2018

(65) Prior Publication Data

US 2019/0063144 A1 Feb. 28, 2019

(30) Foreign Application Priority Data

Aug. 23, 2017 (KR) ..... 10-2017-0106652

(51) Int. Cl.
*E04H 9/00* (2006.01)
*E06B 5/16* (2006.01)
*A62C 2/24* (2006.01)

(52) U.S. Cl.
CPC ..... *E06B 5/16* (2013.01); *A62C 2/241* (2013.01)

(58) Field of Classification Search
CPC ..... E06B 9/02; E06B 9/01; E06B 2009/6818; E06B 2009/005; E06B 9/58; E06B 5/16; E06B 9/70; E06B 9/17; E06B 9/15; A62C 2/241; A62C 2/06; A62C 2/04; A62B 3/00
USPC ..... 49/31, 36, DIG. 1; 52/1, 232
See application file for complete search history.

(56) References Cited

U.S. PATENT DOCUMENTS 5,988,321 A * 11/1999 Kondo ..... B66B 13/303 187/333
5,992,098 A * 11/1999 Flider ..... A62C 2/241 49/367
6,729,701 B2 * 5/2004 Carter ..... A62C 2/242 292/166
9,630,036 B2 * 4/2017 Strum ..... E05B 65/104
9,814,311 B2 * 11/2017 Mueller ..... A47B 96/00
2006/0118356 A1 * 6/2006 Beeson ..... E06B 7/08 181/287

(Continued)

FOREIGN PATENT DOCUMENTS

CN 2720065 8/2005
CN 201343987 11/2009

(Continued)

OTHER PUBLICATIONS

Korean Office Action, with English translation, corresponding to Korean Application No. 10-2017-0106652, dated Jan. 28, 2019.

(Continued)

*Primary Examiner* — Chi Q Nguyen
(74) *Attorney, Agent, or Firm* — Kile Park Reed & Houtteman PLLC

(57) ABSTRACT

Disclosed is a fireproof shutter for opening and closing a passage between an upper story and a lower story. The fireproof shutter includes a base panel having an opening corresponding to the passage, a door for opening and closing the opening, and a guide unit for guiding the door between an open position in which the door is opened and a closed position in which the door is closed and having a predetermined inclination such that the door is closed by its own weight.

22 Claims, 5 Drawing Sheets

(56) References Cited

U.S. PATENT DOCUMENTS

| | | | | |
|---|---|---|---|---|
| 2006/0230695 | A1* | 10/2006 | Swergold | E06B 9/02 52/202 |
| 2009/0090062 | A1* | 4/2009 | Pandorf | E06B 9/02 49/50 |
| 2016/0278517 | A1* | 9/2016 | DeLorean | E04F 19/08 |

FOREIGN PATENT DOCUMENTS

| | | |
|---|---|---|
| CN | 203808757 | 9/2014 |
| JP | 5-51365 | 7/1993 |
| JP | 2009-275497 | 11/2009 |
| KR | 1988-0001425 | 4/1988 |
| KR | 20-1998-0008452 | 4/1998 |
| KR | 20-0406257 | 1/2006 |
| KR | 10-2009-0056822 | 6/2009 |
| KR | 20-0445164 | 7/2009 |
| KR | 10-2017-0012846 | 2/2017 |

OTHER PUBLICATIONS

Decision of Rejection for Amendment, with English translation, corresponding to Korean Application No. 10-2017-0106652, dated Sep. 18, 2019.

Chinese Office Action, with English translation, corresponding to Chinese Application No. 201810966436.4, dated Dec. 10, 2019.

Chinese Office Action, with English translation, corresponding to Chinese Application No. 201810966436.4, dated Aug. 28, 2020.

* cited by examiner

FIREPROOF SHUTTER

CROSS-REFERENCE TO RELATED APPLICATION

This application claims the priority benefit of Korean Patent Application No. 10-2017-0106652, filed on Aug. 23, 2017, and all the benefits accruing therefrom under 35 U.S.C. § 119, the contents of which are incorporated by reference in their entirety.

BACKGROUND

The present disclosure relates to a fireproof shutter. More specifically, the present disclosure relates to a horizontal fireproof shutter for opening and closing a passage between an upper story and a lower story in a multi-story building.

Generally, in a semiconductor or display manufacturing process, materials such as semiconductor wafers or display substrates may be transported in a vertical direction between clean rooms of multiple floors by a tower lift. Each of the floors is provided with an elevating passage of the tower lift, and a fireproof shutter may be provided on the elevating passage to block flames and smoke when a fire occurs.

The fireproof shutter may be opened or closed by a driving unit including a motor. However, when the power supply is cut off, the fireproof shutter may not operate normally even if a fire occurs. In such case, toxic gases due to the fire may be transferred to all floors, and the fire may spread throughout the building.

SUMMARY

The present disclosure provides a fireproof shutter that can stably operate when a fire occur even if power supply is cut off.

In accordance with an aspect of the present disclosure, a fireproof shutter for opening and closing a passage between an upper story and a lower story may include a base panel having an opening corresponding to the passage, a door for opening and closing the opening, and a guide unit for guiding the door between an open position in which the door is opened and a closed position in which the door is closed and having a predetermined inclination such that the door is closed by its own weight.

In accordance with some exemplary embodiments, the fireproof shutter may further include a driving unit including a motor for providing a rotational force and moving the door using the rotational force so as to open the door, and a braking unit applying a braking force to a rotating shaft of the motor so that the door remains in a stopped state at the open position.

In accordance with some exemplary embodiments, the braking unit may include an electromagnetic brake coupled with the rotating shaft of the motor. The electromagnetic brake may release a braking state of the motor when power supply is cut off.

In accordance with some exemplary embodiments, the guide unit may include a guide rail having the predetermined inclination, and a movable member configured to be movable along the guide rail and connected with the door. The door may remain horizontal while being moved between the open and closed positions.

In accordance with some exemplary embodiments, the fireproof shutter may further include a sealing member disposed between the base panel and the door at the closed position.

In accordance with some exemplary embodiments, the fireproof shutter may further include an expansion member disposed between the base panel and the door at the closed position and expanded by heat when a fire occurs to block a gap between the base panel and the door.

In accordance with another aspect of the present disclosure, a fireproof shutter for opening and closing a passage between an upper story and a lower story may include a base panel having an opening corresponding to the passage, a pair of doors configured to be movable in opposite directions between open positions on both sides of the opening and closed positions on the opening, respectively, and guide units for guiding the doors between the open positions and the closed positions. The open positions may be higher than the closed positions, and the guide units may have a predetermined inclination such that the doors are moved by their own weight from the open positions to the closed positions.

In accordance with some exemplary embodiments, each of the guide units may include a guide frame disposed on an edge portion of the base panel, a guide rail mounted to the guide frame and having the predetermined inclination, and a movable member configured to be movable along the guide rail and connected with a corresponding one of the doors.

In accordance with some exemplary embodiments, the fireproof shutter may further include a driving unit comprising a motor for providing a rotational force and moving a first door of the doors using the rotational force so as to open the first door.

In accordance with some exemplary embodiments, the driving unit may further include a chain and sprockets or a timing belt and timing pulleys for connecting the motor and the first door.

In accordance with some exemplary embodiments, the driving unit may further include a second chain and second sprockets or a second timing belt and second timing pulleys for connecting the motor and a second door of the doors.

In accordance with some exemplary embodiments, the fireproof shutter may further include a braking unit applying a braking force to a rotational shaft of the motor so that the first door remains in a stopped state at a corresponding one of the open positions.

In accordance with some exemplary embodiments, the braking unit may include an electromagnetic brake coupled with the rotating shaft of the motor. The electromagnetic brake may release a braking state of the motor when power supply is cut off.

In accordance with some exemplary embodiments, the fireproof shutter may further include lower stoppers for determining the closed positions, and upper stoppers for determining the open positions.

In accordance with some exemplary embodiments, the fireproof shutter may further include shock absorbers for absorbing impacts generated when the doors are closed.

In accordance with some exemplary embodiments, the doors may remain horizontal while being moved between the open positions and the closed positions.

In accordance with some exemplary embodiments, the fireproof shutter may further include sensors for sensing positions of the doors.

In accordance with some exemplary embodiments, the fireproof shutter may further include first sealing members disposed on front portions of the doors facing each other at the closed positions, respectively.

In accordance with some exemplary embodiments, the fireproof shutter may further include first expansion members disposed on front portions of the doors facing each other at the closed positions, respectively, and expanded by heat when a fire occurs to block a gap between the doors.

In accordance with some exemplary embodiments, the fireproof shutter may further include second sealing members disposed between the base panel and the doors at the closed positions.

In accordance with some exemplary embodiments, the fireproof shutter may further include second expansion members disposed between the base panel and the doors at the closed positions and expanded by heat when a fire occurs to block gaps between the base panel and the doors.

In accordance with some exemplary embodiments, the passage is used as an elevating passage of a tower lift, a main frame of the tower lift is disposed in the passage, and front portions of the doors facing each other may have a shape corresponding to the main frame.

The above summary of the present disclosure is not intended to describe each illustrated embodiment or every implementation of the present disclosure. The detailed description and claims that follow more particularly exemplify these embodiments.

BRIEF DESCRIPTION OF THE DRAWINGS

Exemplary embodiments can be understood in more detail from the following description taken in conjunction with the accompanying drawings, in which.

Figure 1:
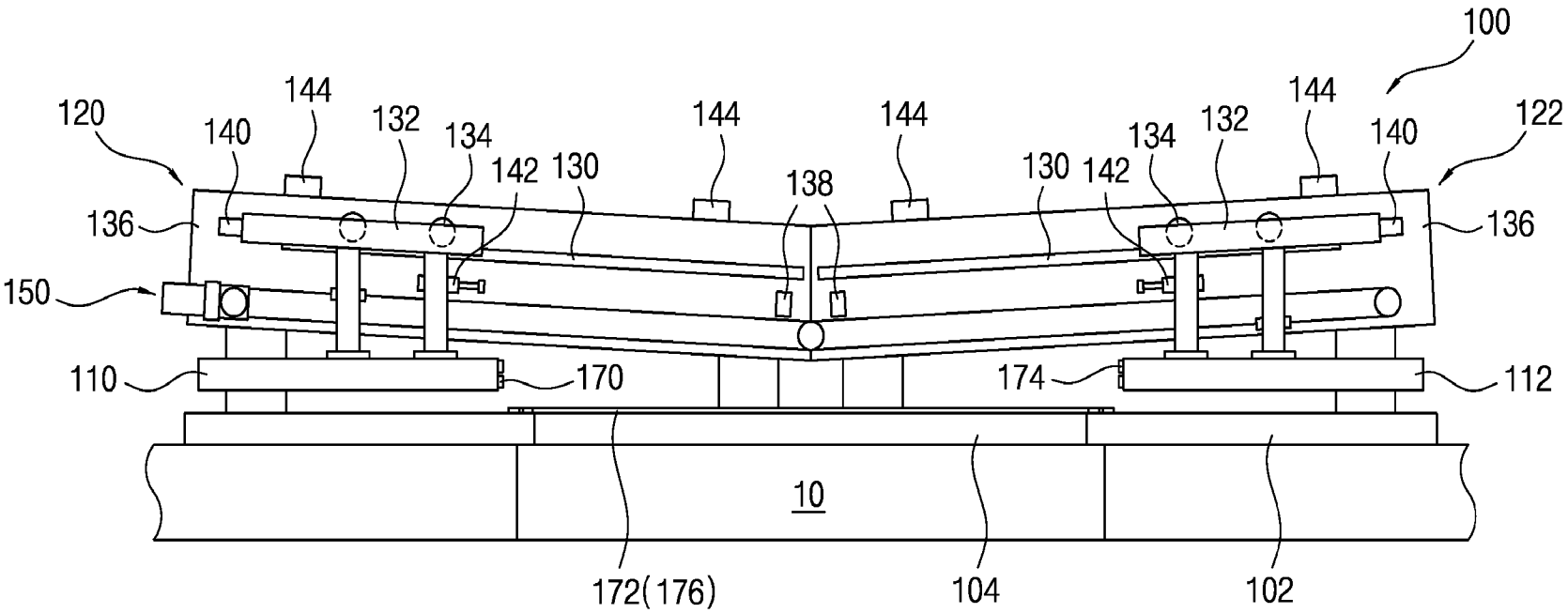
FIG. 1 is a schematic front view illustrating an open state of a fireproof shutter in accordance with an exemplary embodiment of the present disclosure.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Hereinafter, embodiments of the present invention are described in more detail with reference to the accompanying drawings. However, the present invention is not limited to the embodiments described below and is implemented in various other forms. Embodiments below are not provided to fully complete the present invention but rather are provided to fully convey the range of the present invention to those skilled in the art.

In the specification, when one component is referred to as being on or connected to another component or layer, it can be directly on or connected to the other component or layer, or an intervening component or layer may also be present. Unlike this, it will be understood that when one component is referred to as directly being on or directly connected to another component or layer, it means that no intervening component is present. Also, though terms like a first, a second, and a third are used to describe various regions and layers in various embodiments of the present invention, the regions and the layers are not limited to these terms.

Terminologies used below are used to merely describe specific embodiments, but do not limit the present invention. Additionally, unless otherwise defined here, all the terms including technical or scientific terms, may have the same meaning that is generally understood by those skilled in the art.

Embodiments of the present invention are described with reference to schematic drawings of ideal embodiments. Accordingly, changes in manufacturing methods and/or allowable errors may be expected from the forms of the drawings. Accordingly, embodiments of the present invention are not described being limited to the specific forms or areas in the drawings, and include the deviations of the forms. The areas may be entirely schematic, and their forms may not describe or depict accurate forms or structures in any given area, and are not intended to limit the scope of the present invention.

Figure 2:
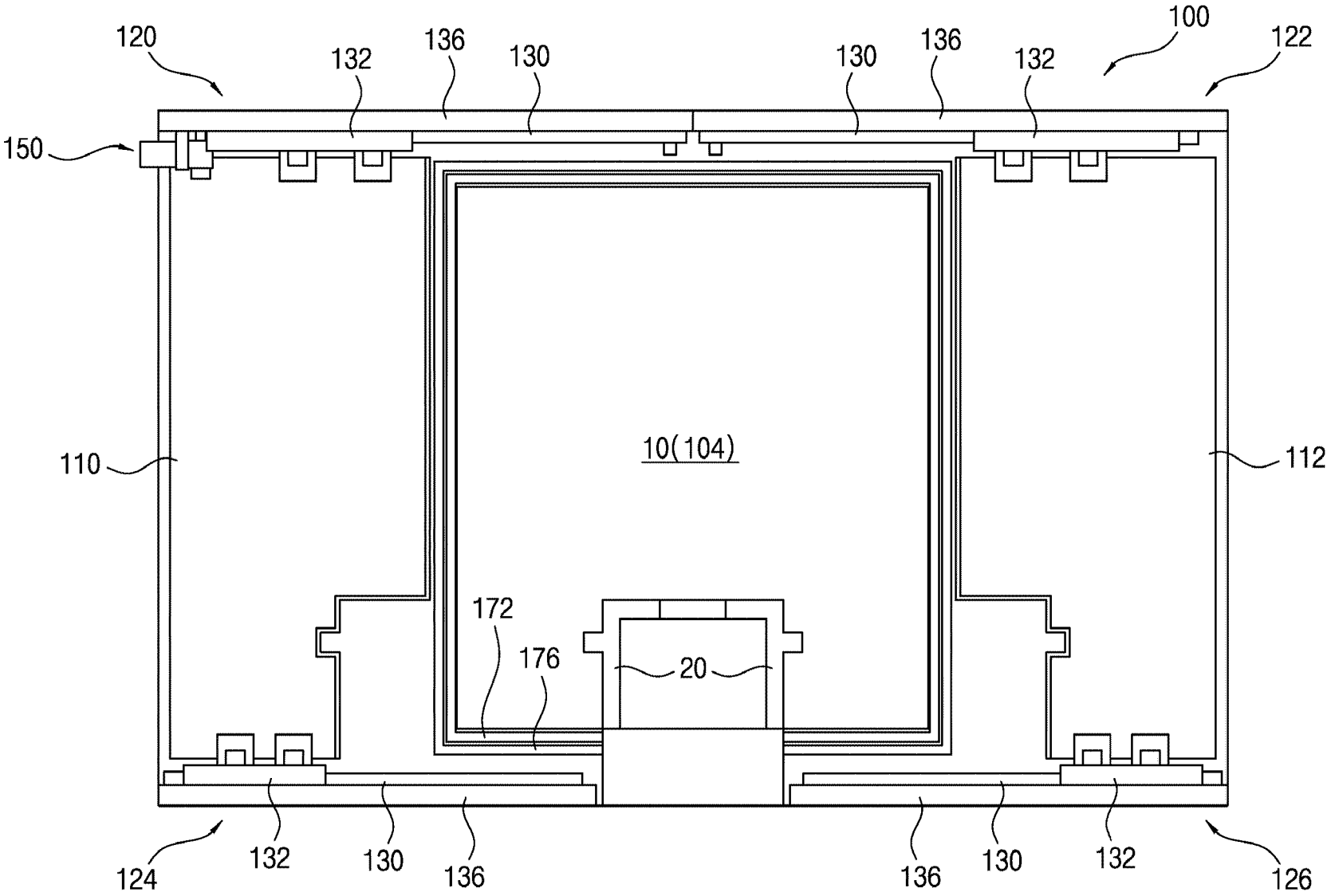
FIG. 2 is a schematic plan view illustrating the open state of the tower lift as shown in FIG. 1.
Figure 3:
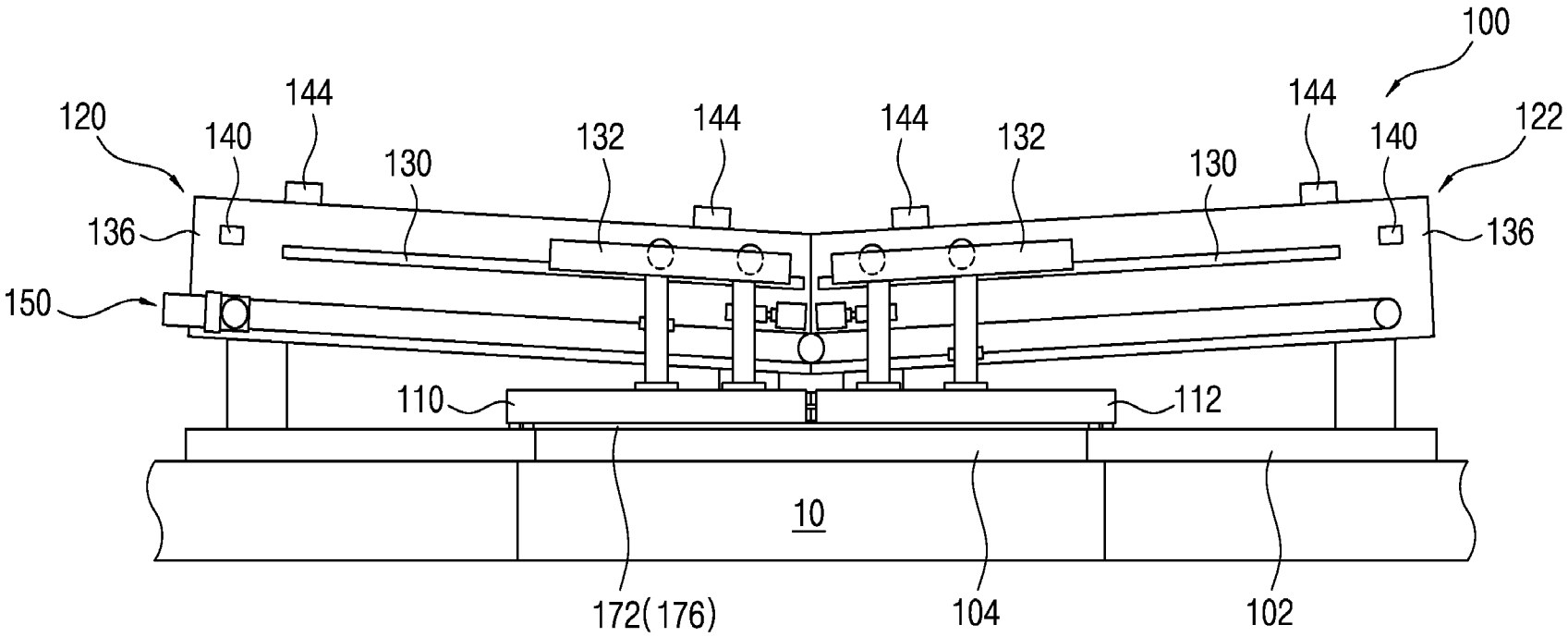
FIG. 3 is a schematic front view illustrating a closed state of the tower lift as shown in FIG. 1.
Figure 4:
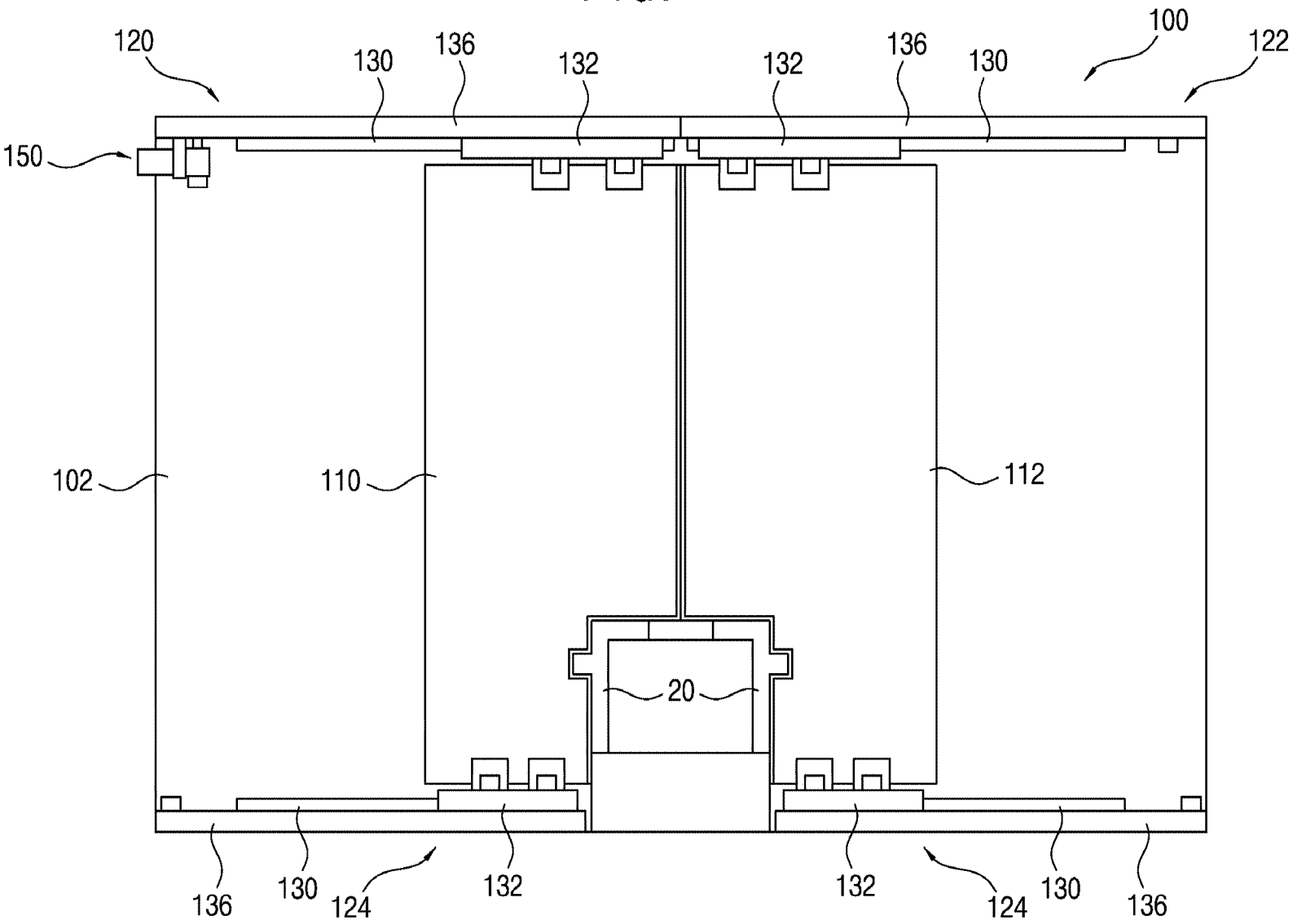
FIG. 4 is a schematic plan view illustrating the closed state of the tower lift as shown in FIG. 1.

FIG. 1 is a schematic front view illustrating an open state of a fireproof shutter in accordance with an exemplary embodiment of the present disclosure, FIG. 2 is a schematic plan view illustrating the open state of the tower lift as shown in FIG. 1, FIG. 3 is a schematic front view illustrating a closed state of the tower lift as shown in FIG. 1, and FIG. 4 is a schematic plan view illustrating the closed state of the tower lift as shown in FIG. 1.

Referring to FIGS. 1 to 4, a fireproof shutter 100, in accordance with an exemplary embodiment of the present disclosure, may be used to open and close a passage between an upper story and a lower story in a building. For example, the fireproof shutter 100 may be used to open and close a passage 10 between upper and lower clean rooms in which a semiconductor manufacturing process is performed. The passage 10 may be used as an elevating passage of a tower lift (not shown). The tower lift may be used to transport a container, such as a FOUP (Font Opening Unified Pod) in which semiconductor wafers are received, between the clean rooms in a vertical direction.

The fireproof shutter 100 may include a base panel 102 having an opening 104 corresponding to the passage 10, a door configured to be movable on the base panel 102 to open and close the opening 104, a guide unit for guiding the door between an open position in which the door is opened and a closed position in which the door is closed. Particularly, the guide unit may have a predetermined inclination such that the door is closed by its own weight.

For example, a pair of doors 110 and 112 and guide units 120, 122, 124 and 126 for guiding the doors 110 and 112 between open positions on both sides of the opening 104 and closed positions on the opening 104 may be disposed on the base panel 102. Particularly, the doors 110 and 112 may be configured to be movable in opposite directions between the open positions and the closed positions, and the open positions may be higher than the closed positions. Further, the guide units 120, 122, 124 and 126 may have a predetermined inclination such that the doors 110 and 112 are moved by their own weight from the open positions to the closed positions, respectively.

More specifically, a first door 110 and a second door 112 may be disposed on the base panel 102, and a first guide unit 120 and a third guide unit 124 for guiding the first door 110 and a second guide unit 122 and a fourth guide unit 126 for guiding the second door 112 may be disposed on edge portions of the base panel 102. The first and third guide units 120 and 124 may be disposed on both sides of the first door 110, and the second and fourth guide units 122 and 126 may be disposed on both sides of the second door 112.

Each of the first, second, third and fourth guide units 120, 122, 124 and 126 may include a guide rail 130 having the predetermined inclination and a movable member 132 configured to be movable along the guide rail 130. The movable members 132 may be connected with the first and second doors 110 and 112, respectively, and the guide rails 130 may be mounted to guide frames 136 disposed on the edge portions of the base panel 102, respectively. Further, each of the movable members 132 may include wheels 134 disposed on a corresponding one of the guide rails 130. Particularly, as shown in figures, the first and second doors 110 and 112 may remain horizontal while being located in the open positions and the closed positions and while being moved between the open positions and the closed positions.

In accordance with an exemplary embodiment of the present disclosure, the fireproof shutter 100 may include a driving unit 150 for opening the first and second doors 110 and 112. The driving unit 150 may include a motor 152 (refer to FIG. 5) for providing a rotational force, and may open the first and second doors 110 and 112 by using the rotational force of the motor 152. Further, the fireproof shutter 100 may include a braking unit 162 for applying a braking force to a rotational shaft of the motor 152 so that the first and second doors 110 and 112 remain in a stopped state at the open positions FIG. 5 is a schematic view illustrating the driving unit as shown in FIG. 1.

Figure 5:
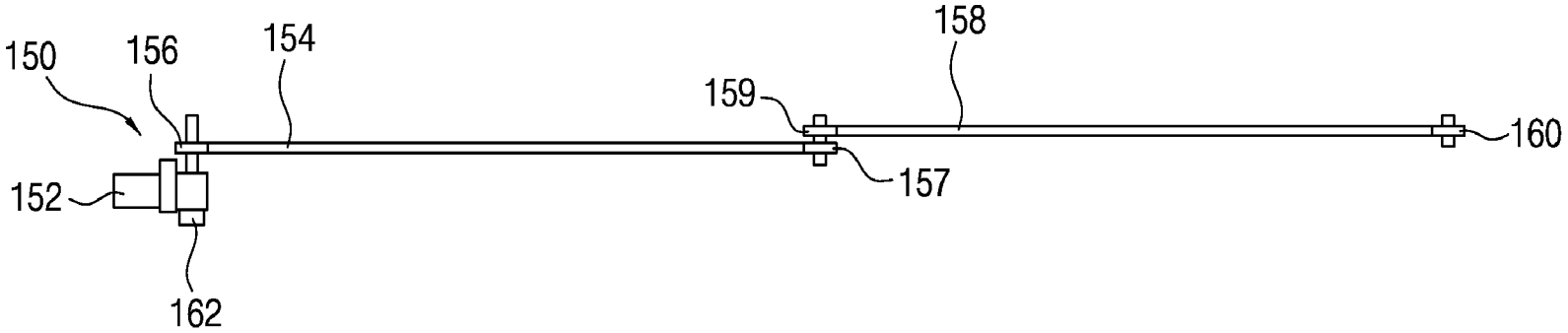
FIG. 5 is a schematic view illustrating a driving unit as shown in FIG. 1.

Referring to FIG. 5, a driving unit 150 may be mounted on the first guide unit 120. The driving unit 150 may include a motor 152 for providing a rotational force, and a braking unit 162 may be connected with a rotational shaft of the motor 152. For example, an electromagnetic brake may be used as the braking unit 162. The electromagnetic brake may release a braking state of the motor when power supply to the motor is cut off.

Though not shown in figures, the electromagnetic brake may include a coil for generating an electromagnetic force and may apply the braking force to the rotational shaft of the motor 152 by using the electromagnetic force. Further, the electromagnetic brake may release the braking state of the motor 152 in order to close the first and second doors 110 and 112. Particularly, when a fire occurs and the power supply to the motor 152 and the braking unit 162 is cut off, the braking state of the motor 152 by the electromagnetic brake may be released, and the first and second doors 110 and 112 may thus be closed by their own weight along the guide rails 130.

The driving unit 150 may include a chain 154 and sprockets 156 and 157 or a timing belt and timing pulleys to connect the motor 152 and the first door 110. The first door 110 may be connected with the chain 154 or timing belt, and the sprockets 156 and 157 or timing pulleys may be mounted on the guide frame 136 of the first guide unit 120. Further, the driving unit 150 may include a second chain 158 and second sprockets 159 and 160 or a second timing belt and second timing pulleys to connect the motor 152 and the second door 112. The second door 112 may be connected with the second chain 158 or timing belt, and the second sprockets 159 and 160 or timing pulleys may be mounted on the guide frame 136 of the second guide unit 122. As shown in FIG. 5, the chain 154 and the second chain 158 may be connected with each other by the first and second sprockets 157 and 159. Thus, the first and second doors 110 and 112 may be simultaneously opened by the motor 152.

In accordance with an exemplary embodiment of the present disclosure, the fireproof shutter 100 may include lower stoppers 138 for determining the closed positions and upper stoppers 140 for determining the open positions. The lower stoppers 138 and the upper stoppers 140 may be mounted on guide frames 136 of the first and second guide units 120 and 122, and may limit movement distances of the movable members 132 connected with the first and second doors 110 and 112. Further, shock absorbers 142 for absorbing impacts generated when the first and second doors 110 and 112 are closed may be mounted to the movable members 132.

The first and second guide units 120 and 122 may include sensors 144 for sensing positions of the first and second doors 110 and 112. For example, optical sensors 144 for sensing the first and second doors 110 and 112 at the open and closed positions may be mounted on the guide frames 136 of the first and second guide units 120 and 122.

Referring to FIGS. 2 and 4, a main frame 20 of the tower lift may be disposed in the passage 10. In accordance with an exemplary embodiment of the present disclosure, front portions of the first and second doors 110 and 112 facing each other may have a shape corresponding to the main frame 20 of the tower lift. That is, the front portions of the first and second doors 110 and 112 may be brought into contact with the main frame 20 of the tower lift at the closed positions.

Further, an inner space of the main frame 20 may be used as an elevating passage of a weight module of the tower lift, and a second fireproof shutter (not shown) may be disposed in the main frame 20.

Referring FIGS. 1 and 2, first sealing members 170 having a tape shape may be disposed on the front portions of the first and second doors 110 and 112 facing each other, respectively, in order to block smoke and toxic gases due to the fire. Second sealing members 172 having a tape shape may be attached on lower surfaces of the first and second doors 110 and 112 or an upper surface of the base panel 102 in order to block gaps between the first and second doors 110 and 112 and the base panel 102 at the closed positions.

Further, first expansion members 174 having a tape shape may be disposed on the front portions of the first and second doors 110 and 112, respectively. The first expansion members 174 may be expanded by heat when a fire occurs, thereby blocking a gap between the first and second doors 110 and 112 at the closed positions. Second expansion members 176 having a tape shape may be attached on the lower surfaces of the first and second doors 110 and 112 or the upper surface of the base panel 102 in order to block the gaps between the first and second doors 110 and 112 and the base panel 102 at the closed positions. For example, Fi-Block (registered trademark) available from Sekisui Chemical Co., Ltd. may be used as the first and second expansion members 174 and 176.

In accordance with the exemplary embodiments of the present disclosure as described above, a fireproof shutter 100 may include a base panel 102 having an opening 104 corresponding to a passage 10 between an upper story and a lower story, a pair of doors 110 and 112 for opening and closing the opening 104, and guide units 120, 122, 124 and 126 having a predetermined inclination such that the doors 110 and 112 are closed by their own weight. Particularly, the fireproof shutter 100 may include a driving unit 150 for moving the doors 110 and 112, and a braking unit 162 for applying a braking force to a motor 152 of the driving unit 150 such the doors 110 and 112 remain in a stopped state at closed positions. The braking unit 162 may release a braking state of the motor 152 when a fire occurs so that the doors 110 and 112 are closed by their own weight.

The braking unit 162 may include an electromagnetic brake for releasing the braking state of the motor 152 when power supply is cut off. Thus, even if a fire occurs and power supply is cut off, the fireproof shutter 100 may be stably operated, and toxic gases, smoke and flames or the like due to the fire may be effectively blocked by the fireproof shutter 100.

Although the fireproof shutter 100 has been described with reference to specific embodiments, it is not limited thereto. Therefore, it will be readily understood by those skilled in the art that various modifications and changes can be made thereto without departing from the spirit and scope of the present disclosure defined by the appended claims.

The invention claimed is:

1. A fireproof shutter, comprising:

a base panel disposed in a horizontal direction and having an opening corresponding to a passage disposed between an upper story and a lower story of a structure;

a door disposed in a horizontal direction and configured to open and close the opening;

a guide unit configured to guide the door between an open position in which the door is opened and a closed position in which the door is closed and having a predetermined inclination such that the door is closed by the weight of the door, and an expansion member configured to expand by heat when a fire occurs to block a gap between the base panel and the door.

2. The fireproof shutter of claim 1, further comprising:

a driving unit comprising a motor for providing a rotational force and moving the door using the rotational force so as to open the door; and a braking unit applying a braking force to a rotating shaft of the motor so that the door remains in a stopped state at the open position.

3. The fireproof shutter of claim 2, wherein the braking unit comprises an electromagnetic brake coupled with the rotating shaft of the motor, and the electromagnetic brake releases a braking state of the motor when power supply is cut off.

4. The fireproof shutter of claim 1, wherein the guide unit comprises:

a guide rail having the predetermined inclination; and a movable member configured to be movable along the guide rail and connected with the door, wherein the door remains horizontal while being moved between the open and closed positions.

5. The fireproof shutter of claim 1, further comprising a sealing member disposed between the base panel and the door at the closed position.

6. The fireproof shutter of claim 1, wherein the expansion member is disposed between the base panel and the door at the closed position.

7. A fireproof shutter, comprising:

a base panel disposed in a horizontal direction and having an opening corresponding to a passage disposed between an upper story and a lower story of a structure;

a pair of doors disposed in a horizontal direction and configured to be movable in opposite directions between open positions on both sides of the opening and closed positions on the opening, respectively;

guide units configured to wide the doors between the open positions and the closed positions; and first expansion members configured to expand by heat when a tire occurs to block a gap between the doors, wherein the open positions are higher than the closed positions, and the guide units have a predetermined inclination such that the doors are moved by the weight of the doors from the open positions to the closed positions.

8. The fireproof shutter of claim 7, wherein each of the guide units comprises:

a guide frame disposed on an edge portion of the base panel;

a guide rail mounted to the guide frame and having the predetermined inclination; and a movable member configured to be movable along the guide rail and connected with a corresponding one of the doors.

9. The fireproof shutter of claim 7, further comprising a driving unit comprising a motor for providing a rotational force and moving a first door of the doors using the rotational force so as to open the first door.

10. The fireproof shutter of claim 9, wherein the driving unit further comprises a chain and sprockets or a timing belt and timing pulleys for connecting the motor and the first door.

11. The fireproof shutter of claim 10, wherein the driving unit further comprises a second chain and second sprockets or a second timing belt and second timing pulleys for connecting the motor and a second door of the doors.

12. The fireproof shutter of claim 9, further comprising a braking unit applying a braking force to a rotational shaft of the motor so that the first door remains in a stopped state at a corresponding one of the open positions.

13. The fireproof shutter of claim 12, wherein the braking unit comprises an electromagnetic brake coupled with the rotating shaft of the motor, and the electromagnetic brake releases a braking state of the motor when power supply is cut off.

14. The fireproof shutter of claim 7, further comprising:

lower stoppers for determining the closed positions; and upper stoppers for determining the open positions.

15. The fireproof shutter of claim 7, further comprising shock absorbers for absorbing impacts generated when the doors are closed.

16. The fireproof shutter of claim 7, wherein the doors remain horizontal while being moved between the open positions and the closed positions.

17. The fireproof shutter of claim 7, further comprising sensors for sensing positions of the doors.

18. The fireproof shutter of claim 7, further comprising first sealing members disposed on front portions of the doors facing each other at the closed positions, respectively.

19. The fireproof shutter of claim 7, where in the first expansion members are disposed on front portions of the doors facing each other at the closed positions, respectively.

20. The fireproof shutter of claim 7, further comprising second sealing members disposed between the base panel and the doors at the closed positions.

21. The fireproof shutter of claim 7, further comprising second expansion members disposed between the base panel and the doors at the closed positions and expanded by heat when a fire occurs to block gaps between the base panel and the doors.

22. The fireproof shutter of claim 7, wherein the passage is used as an elevating passage of a tower lift;

a main frame of the tower lift is disposed in the passage; and front portions of the doors facing each other have a shape corresponding to the main frame.

* * * * *